US006875035B2

(12) United States Patent
Sakiyama

(10) Patent No.: US 6,875,035 B2
(45) Date of Patent: Apr. 5, 2005

(54) CONNECTOR AND ELECTRIC CONNECTION STRUCTURE

(75) Inventor: Koji Sakiyama, Sakura (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 10/316,022

(22) Filed: Dec. 11, 2002

(65) Prior Publication Data

US 2003/0114032 A1 Jun. 19, 2003

(30) Foreign Application Priority Data

Dec. 18, 2001 (JP) ..... 2001-384787

(51) Int. Cl.[7] ..... H01R 13/53
(52) U.S. Cl. ..... 439/181
(58) Field of Search ..... 439/181, 39, 183

(56) References Cited

U.S. PATENT DOCUMENTS

| | | | | |
|---|---|---|---|---|
| 283,167 | A | 8/1883 | Thomson | |
| 3,892,461 | A | 7/1975 | Keto | |
| 4,786,770 | A | 11/1988 | Hamano et al. | |
| 5,837,953 | A | 11/1998 | Ito et al. | |
| 6,491,532 | B1 * | 12/2002 | Schoepf et al. | 439/181 |
| 6,616,468 | B2 * | 9/2003 | Sakiyama | 439/181 |
| 2001/0031565 | A1 * | 10/2001 | Sakiyama | 439/38 |

OTHER PUBLICATIONS

Koji Sakiyama, et al., "A New Connector for 42V Automotive Electrical System" SAE Technical Paper Series 2001–01–0724, SAE International, The Engineering Society for Advancing Mobility Land Sea Air and Space,. SAE 2001 World Congress, pp. 1–5.

* cited by examiner

*Primary Examiner*—P. Austin Bradley
*Assistant Examiner*—Phuongchi Nguyen
(74) *Attorney, Agent, or Firm*—Sughrue Mion, PLLC

(57) ABSTRACT

A connector includes a first connector having a first connector housing which supports plural first connection terminals in its inside and a second connector having a second connector housing which supports plural second connection terminals connected to the plural first connection terminals in its inside. At least one magnetic member disposed in the first connector housing or second connector housing. The magnetic member is disposed to be held between leading ends of the plural first connection terminals or between leading ends of the plural second connection terminals, and a magnetic field is generated in a direction orthogonal to a direction in which the both first and second connection terminals are inserted during a period of time from complete engagement of the first and second members to complete disengagement thereof, or a period of time from complete disengagement of the first and second connectors to complete engagement thereof.

16 Claims, 5 Drawing Sheets

CONNECTOR AND ELECTRIC CONNECTION STRUCTURE

CROSS-REFERENCE TO RELATED APPLICATIONS

This application is based upon and claims the benefit of priority from the prior Japanese Patent Application No. 2001-384787, filed Dec. 18, 2001, the entire contents of which are incorporated herein by reference.

BACKGROUND OF THE INVENTION

1. Field of the Invention

The present invention relates to a connector and electric connection structure applicable to electric connection parts of harness connected to a load of a large electric power or electric connection parts of fuse blocks in a wiring system which is used in automobiles and the like, and more particularly to a connector and electric connection structure capable of preventing vehicle fire or the like due to melting or discharge spark of connector terminals by electric discharge when inserting and removing.

2. Description of the Related Art

Along with a rapid electronic progress in the entire society, comfort and convenience are demanded, for example, in the automobile which is one of the transportation means hitherto regarded only as a moving tool, and various electronic parts have come to be installed such as car navigation system and electronically controlled suspension system which operate under the central control system by a computer. In addition to the pursuit of comfort and convenience, environmental problems represented by automotive emission are global issues, and automotive devices are in the trend of shift from mechanical control to electrical control. For example, the power of the power steering system was conventionally obtained from the rotating force of the engine. However, recently an electric power steering device for generating power electrically is mounted, and it is attempted to use so-called clean electric energy without polluting the environments. As the automotive devices are going electronic, the electric load of automotive devices used in the automobile, which is hundreds of watts (W) at maximum at the present, is predicted to increase to 5 to 6 kW in future, and at the same time the electric power must be supplied efficiently, and it is proposed to elevate the vehicle supply voltage from 14 volts (V) at the present to 42 volts.

However, during operation of automotive devices of such large electric power load, when the connector of the wire harness for connecting the devices is pulled out or inserted, the so-called arc discharge is generated, and its energy may not only melt down the connector terminal, but also induces a discharge spark in succession. In an extreme case, a vehicle fire may take place. One of the causes is a prolonged state of incomplete connection relation between the connector and connector terminal. Or if the vehicle is driven while the connector is not coupled or fitted only halfway, contact and separation of the first connection terminal and second connection terminal of the connector are intermittently repeated due to vibration during travel, and the so-called chattering occurs. In such a case, too, arc discharge occurs continuously.

BRIEF SUMMARY OF THE INVENTION

An object of the present invention is to provide a connector and electric connection structure capable of preventing vehicle fire or the like due to continuous melting or discharge spark of connector terminals by arc discharge when inserting and removing the connector.

According to an aspect of the present invention, there is provided a connector comprising: a first connector having a first connector housing which supports plural first connection terminals in its inside; a second connector having a second connector housing which supports plural second connection terminals connected to the plural first connection terminals in its inside; and a magnetic member disposed in at least one of the first connector housing and second connector housing, wherein the magnetic member is disposed so as to be held between leading ends of the plural first connection terminals or between leading ends of the plural second connection terminals, and a magnetic field is generated in a direction orthogonal to a direction in which the both first and second connection terminals are inserted during a period of time from complete engagement of the first and second connectors to complete disengagement thereof, or a period of time from complete disengagement the first and second connectors to complete engagement thereof.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiment of the invention, and together with the general description given above and the detailed description of the preferred embodiment given below, serve to explain the principles of the invention.

DETAILED DESCRIPTION OF THE INVENTION

Referring now to the accompanying drawings, an embodiment of the invention will be described below.

Figure 1:
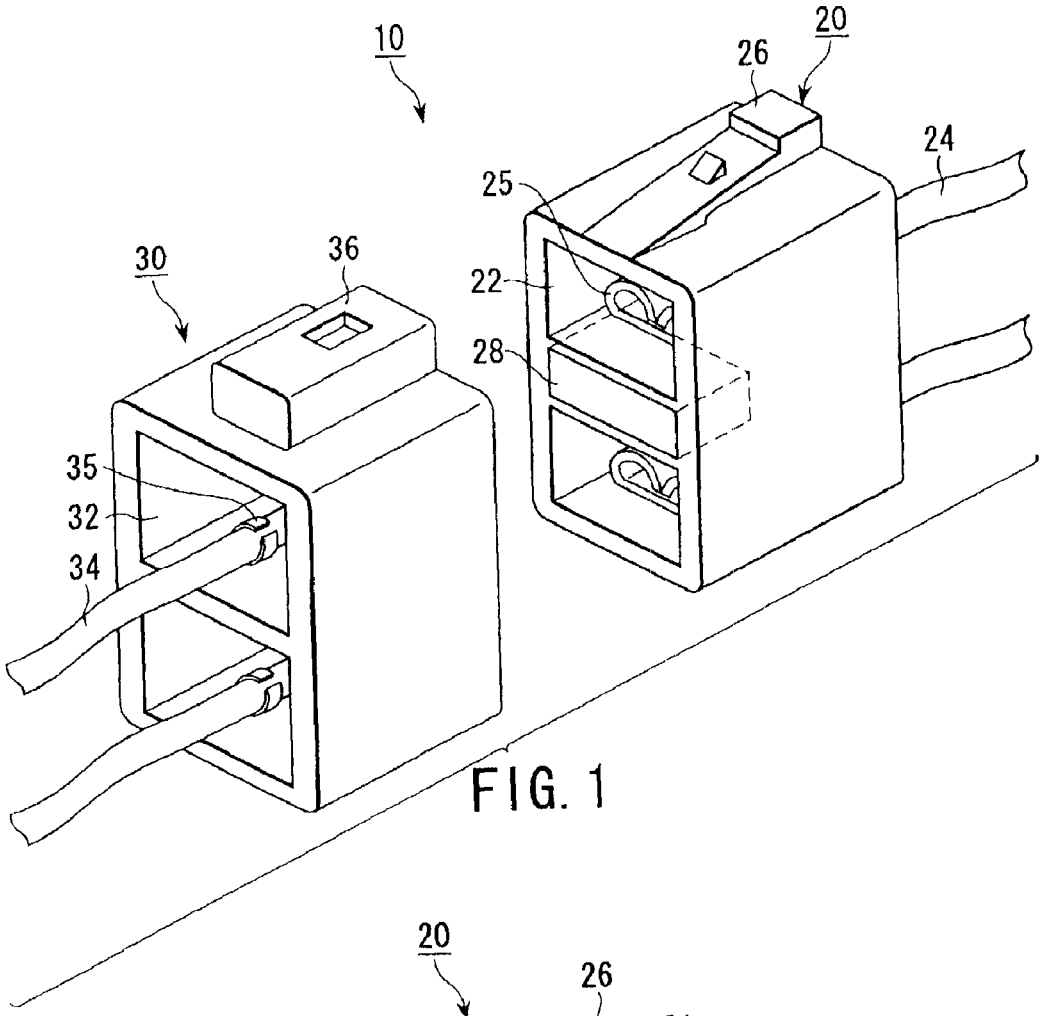
FIG. 1 is a perspective view showing a connector for wiring connection according to an embodiment of the invention.
Figure 2:
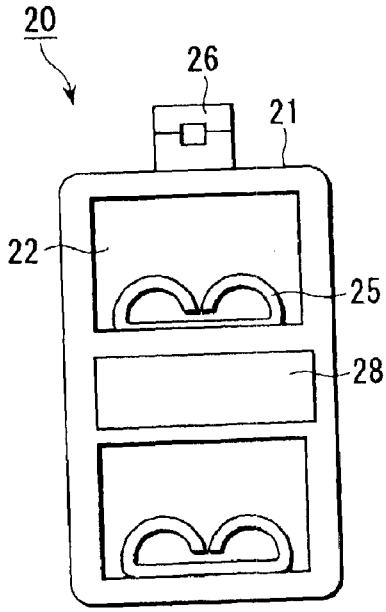
FIG. 2 is a front view showing a first connector of the connector for wiring connection.
Figure 3:
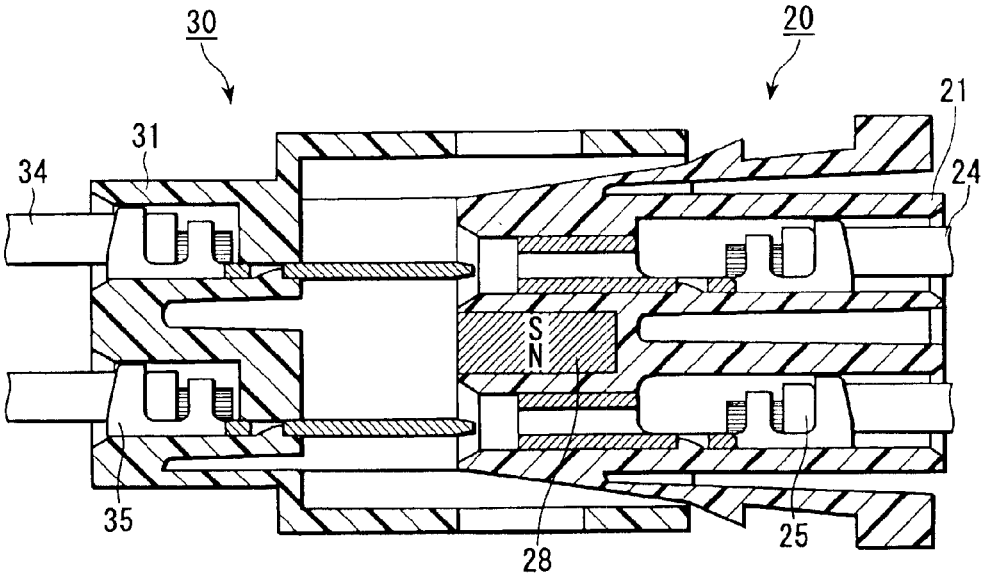
FIG. 3 is a longitudinal sectional view showing a half fitted state of two connectors of the connector for wiring connection.

FIG. 1 is a perspective view showing a connector for wiring connection according to an embodiment of the invention, FIG. 2 is a front view showing a first connector of the connector for wiring connection, and FIG. 3 is a longitudinal sectional view showing a half fitted state of two connectors.

A connector for wiring connection 10 of this embodiment is composed of, for example, a first connector (plug connector) 20 and a second connector (receptacle connector) 30 each having connection terminals for a large electric power load disposed in two stages in the vertical direction.

The first connector 20 is composed as follows. That is, in a first connector housing 21 formed of a synthetic resin or the like, plural terminal accommodating holes 22 extending in the connector fitting direction are formed in two stages in the vertical direction of the first connector housing 21, and a first connection terminal 25 press-fitted to a leading end of an electric wire 24 branched off from a harness (not shown) for connection of a large electric power load is accommodated in the terminal accommodating holes 22. In the housing frame portion between the terminal accommodating holes 22, a magnetic member (a rectangular permanent magnet 28 in this embodiment) is incorporated. This permanent magnet 28 is preferably disposed at a position exposed to the strongest magnetic force in a place where arc discharge occurs, for example, between the first and second connection terminals 25 and 35. The magnet 28 is incorporated in the housing frame portion so that, for example, the upper direction may be the S pole and the lower direction may be the N pole in FIG. 1. A stopping pawl 26 having an elastic stopping piece is formed on outer wall of the first connector housing 21 in the upper direction in FIG. 1.

On the other hand, the second connector 30 is composed as follows. That is, in a second connector housing 31 formed of a synthetic resin or the like, a second connection terminal 35 press-fitted to a leading end of an electric wire 34 branched off from a harness (not shown) for connection of a large electric power load is formed in two stages in the vertical direction of the second connector housing 31, corresponding to the first connection terminal 25 of the first connector 20, and is accommodated in plural terminal accommodating holes 32 extending in the connector fitting direction. On the outer wall of the second connector housing 31 in the upper direction in FIG. 1, a stopping portion 36 is formed for stopping and fixing the both connectors 20, 30 as being engaged with the stopping pawl 26 formed in the first connector housing 21 when the both connectors 20, 30 are fitted completely. Together with the stopping pawl 26, it composes a lock mechanism of the connector for wiring connection 10.

Figure 4:
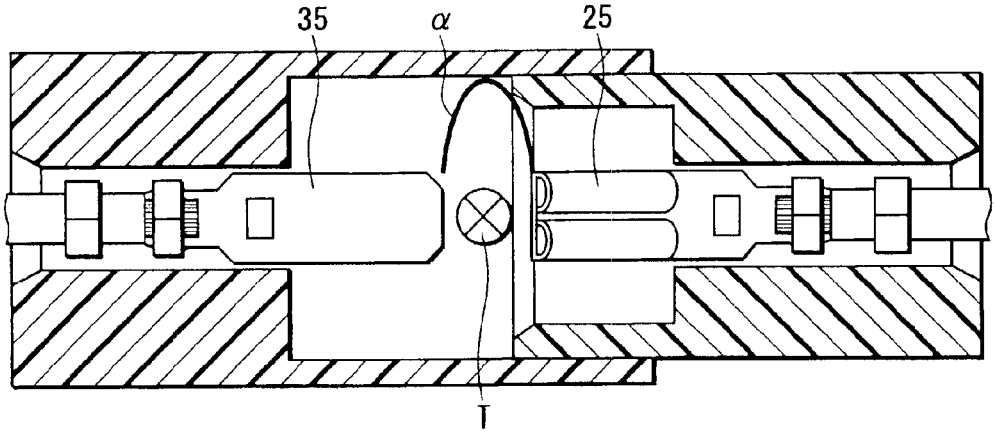
FIG. 4 is a diagram for explaining the trajectory of arc discharge occurring between two connection terminals.

According to the connector for wiring connection 10 having such configuration, when engaging/disengaging the first connector 20 with/from the second connector 30, as shown in FIG. 3, Lorentz force is generated by the action of a magnetic field T generated in a direction orthogonal to the direction in which the both connection terminals 25, 35 are fitted by the permanent magnet 28 disposed in the first connector housing 21. Accordingly, for example, as depicted by parabola α in FIG. 4, the electron of arc generated between the both connection terminals 25 and 35 is bent, and the trajectory of the arc discharge is drawn very far from the direct distance between the two connection terminals 25 and 35. Therefore, destructive effects of the arc discharge on the connection terminals 25 and 35 can be decreased, so that melting of connection terminals can be prevented effectively. In the case of the connector for wiring connection without permanent magnet 28, usually, arc discharge is terminated when the both connection terminals are apart from each other by a specified distance. However, when the permanent magnet 28 is provided in the first connector housing 21 as in the case of the connector for wiring connection 10 of this embodiment, the specified distance can be instantly reserved on the moment of change from contact to separation, or from separation to contact of the two connection terminals 25, 35.

Figure 5:
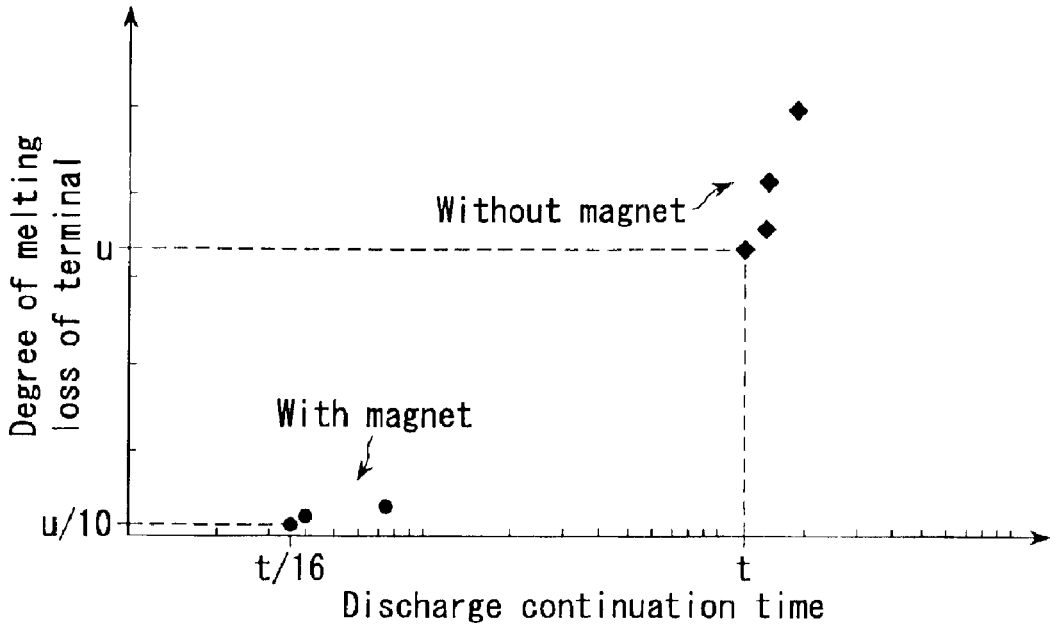
FIG. 5 is a graph showing the relation between the discharge continuation time and the degree of melting loss of terminals.

The difference in effects on the arc whether or not the permanent magnet 28 is provided in the first connector housing 21 is known from the graph in FIG. 5. That is, according to the experiment by the applicant of the invention, without the permanent magnet 28, the discharge continuation time was t, and the terminal melt loss degree was u, and with the permanent magnet 28, the discharge continuation time was about 1/16 or less, and the terminal melt loss was about 1/10 or less. This difference is variable by adjustment of the magnetic force of the permanent magnet 28, change of arrangement position or the like, and further better results may be obtained.

Figure 6:
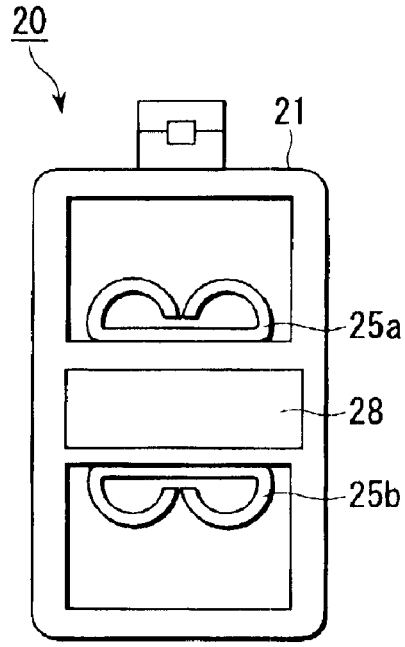
FIG. 6 is a front view showing another first connector of the connector for wiring connection.

Also depending on the mode of arrangement of the connection terminal 25 (35), the effect of the permanent magnet 28 varies. Thus, as shown in FIG. 6, for example, the connection terminal 25 (35) may be disposed in a symmetrical state to the permanent magnet 28 (for example, in a confronting state of plate faces of the connection terminals 25*a* and 25*b*). In this configuration, since the connection terminals 25*a*, 25*b* can be further brought closer to the permanent magnet 28, and a strong magnetic field is realized by the connection terminals 25*a*, 25*b*. Destructive effects of arc discharge on the connection terminal 25 (35) can be further decreased, thereby melting of connection terminals can be effectively prevented.

Figure 7:
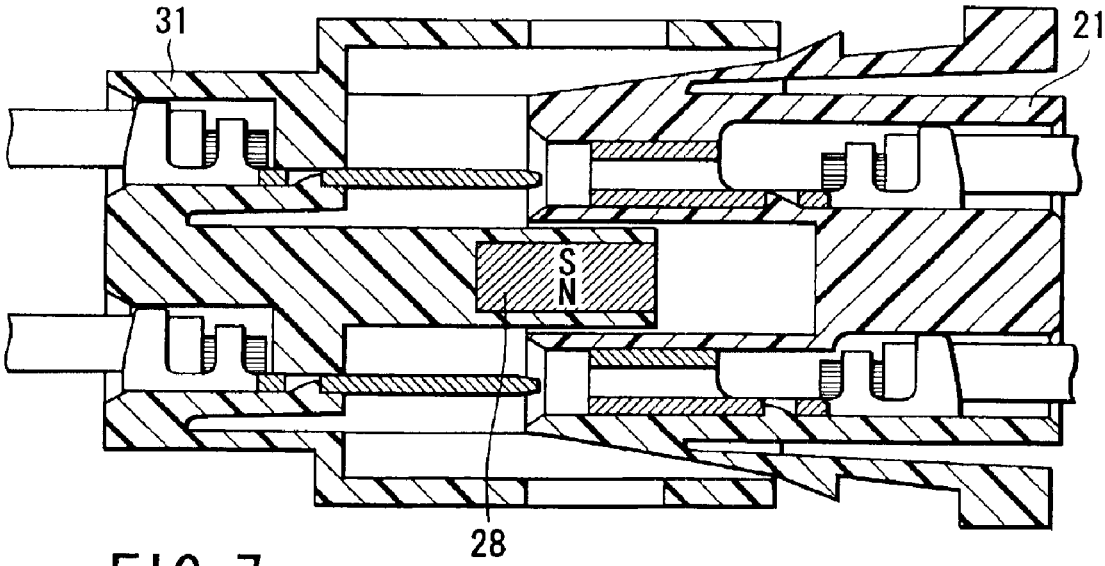
FIG. 7 is a longitudinal sectional view showing a half fitted state of other two connectors of the connector for wiring connection.

In this embodiment, the permanent magnet 28 is disposed in the first connector housing 21. To the contrary, as shown in FIG. 7, the permanent magnet 28 may be disposed in the second connector housing 31. As the magnetic member, instead of the permanent magnet 28, for example, an electromagnet or the like may be also used.

Figure 9:
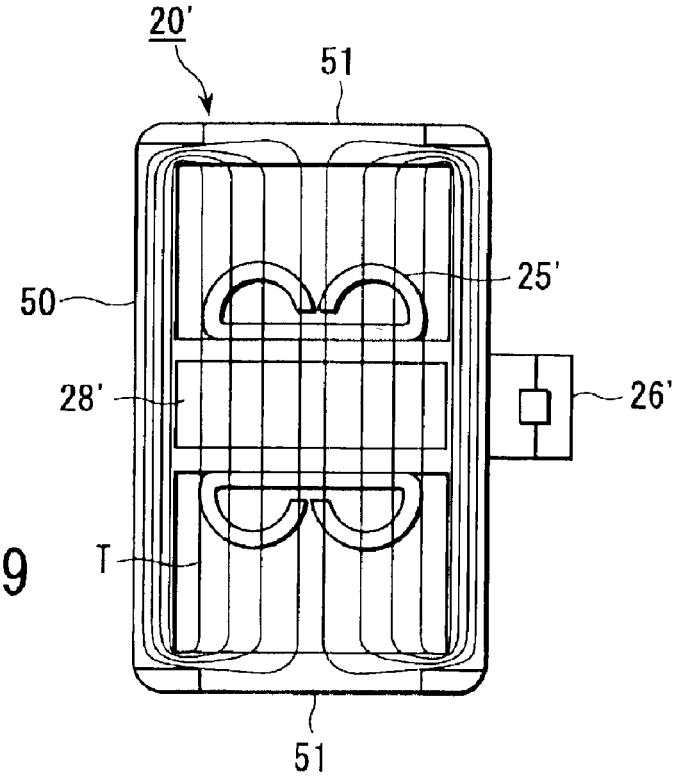
FIG. 9 is a schematic front view showing a magnetic field generated in a first connector of the connector for wiring connection.
Figure 8:
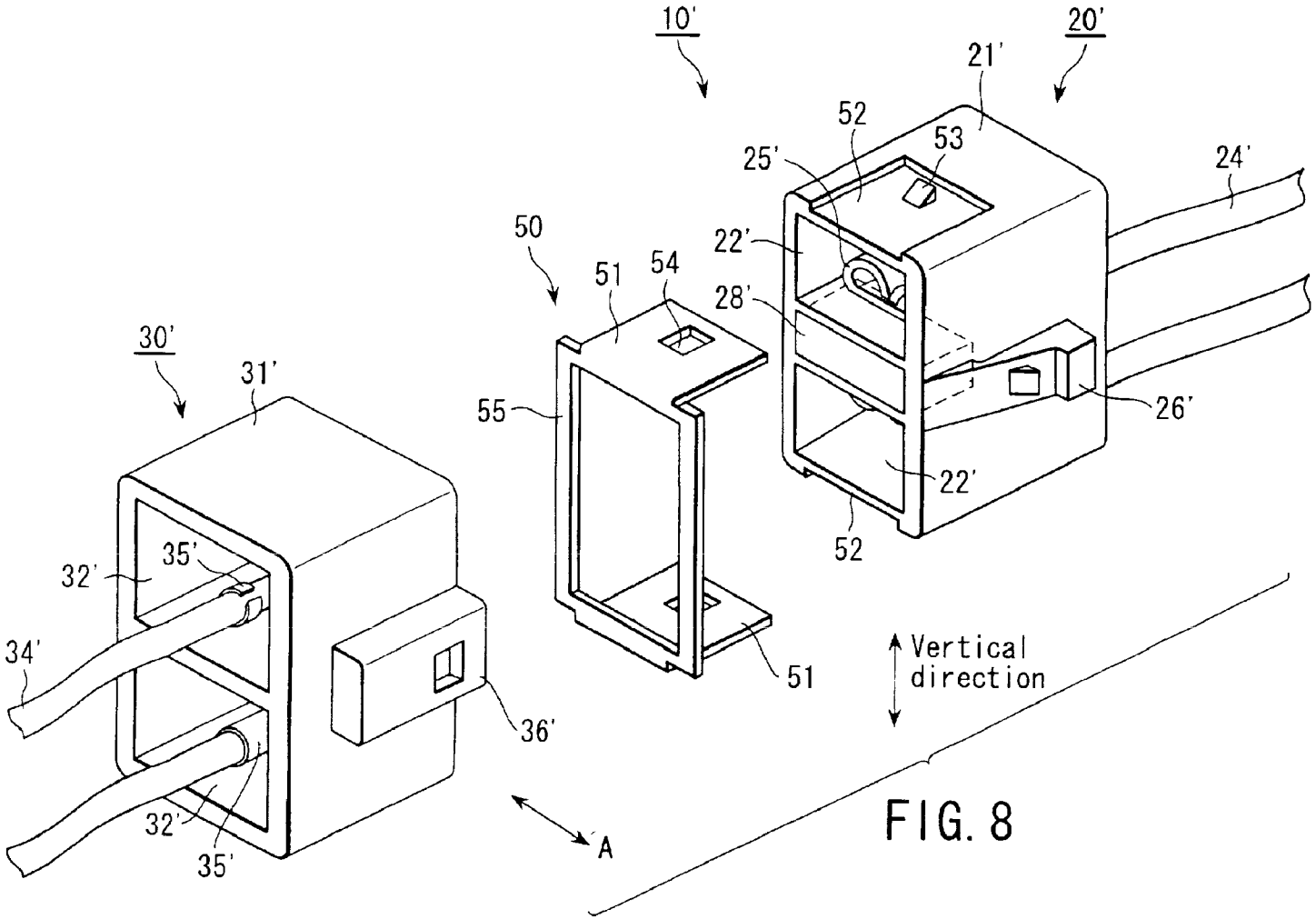
FIG. 8 is a perspective view showing a connector for wiring connection according to another embodiment of the invention.

FIG. 8 is a perspective view showing a connector for wiring connection according to another embodiment of the invention, and FIG. 9 is a schematic front view showing a magnetic field generated in a first connector of the connector for wiring connection.

The connector for wiring connection 10' of this embodiment is composed of a first connector (plug connector) 20' and a second connector (receptacle connector) 30', for example, having connection terminals for large electric power load disposed in two stages in the vertical direction.

The first connector 20' is composed as follows. That is, in a first connector housing 21' formed of synthetic resin or the like, plural terminal accommodation holes 22' extending in the connector fitting direction are formed in two stages in the vertical direction of the first connector housing 21', and a first connection terminal 25' crimped to the leading ends of wires 24' branched off from a connection harness (not shown) for large electric power load is accommodated in the terminal accommodation holes 22'. In the housing frame portion between these terminal accommodation holes 22', a magnetic member (a rectangular permanent magnet 28' in this embodiment) is incorporated. The permanent magnet 28' is preferably disposed at a position exposed to the strongest magnetic force, for example, where arc discharge occurs between the first and second connection terminals 25', 35', and specifically incorporated in the housing frame portion such that the upper direction is the S pole and the lower direction is the N pole in FIG. 8. In the outer walls at upper and lower positions in FIG. 8 of the first connector housing 21', engagement recesses 52 for engaging with a yoke 50 are formed, respectively. The yoke 50 is a U-shaped ferromagnetic element composed of an annular portion 55 formed along an outer periphery of a front side of the first connector housing 21', and an engaging piece 51 extending at right angle to the annular portion 55 from the upper and lower parts of the annular portion 55. The engaging piece 51 of the yoke 50 is engaged with the engagement recess 52 of the first connector housing 21', and an engaging projection 53 of the engagement recess 52 is fitted into an engaging hole 54 of the engaging piece 51, so that the yoke 50 is attached to the first connector housing 21'. The yoke 50 is disposed such that the magnetic field T generated by the permanent magnet 28' having the first connection terminal 25' pinched by the engaging pieces 51 is concentrated on the first connection terminal 25' as shown in FIG. 9. On the outer wall in the direction of A in FIG. 8 of the first connector housing 21', a locking claw 26' having an elastic stopping piece is formed.

On the other hand, the second connector 30' is composed as follows. That is, in a second connector housing 31' formed of synthetic resin or the like, in correspondence to the first connection terminal 25' of the first connector 20', a second connection terminal 35' crimped to the leading ends of wires 34' branched off from a connection harness (not shown) for large electric power load is formed in two stages in the vertical direction of the second connector housing 31', and accommodated in plural terminal accommodation holes 32' extending in the connector fitting direction. On the outer wall in the direction of A in FIG. 8 of the second connector housing 31', a locking portion 36' is formed for locking and fixing the both connectors 20', 30' by engaging with the both connectors 20', 30' (it, together with the locking claw 26', composes a lock mechanism of the connector for wiring connection 10').

According to the connector for wiring connection 10' thus configured, when fitting/separating the first connector 20' and second connector 30', a Lorentz force is generated by the action of the magnetic field T generated so as to be concentrated in a direction orthogonal to the engaging direction of the both connection terminals 25', 35' by the permanent magnet 28' and yoke 50 disposed in the first connector housing 21'. Then, the electron of the arc generated between the both connection terminals 25', 35' is bent, and the trajectory of arc discharge is drawn far remote from the linear distance between the connection terminals 25', 35'. This makes it possible to reduce destructive effects of the arc discharge on the both connection terminals 25', 35', and melting loss of connection terminals can be prevented further effectively. Also in this embodiment, the permanent magnet 28' is disposed in the first connector housing 21'. To the contrary, the permanent magnet 28' may be disposed in the second connector housing 31', and aside from the permanent magnet 28', for example, an electromagnet may be also used.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A connector comprising:

a first connector having a first connector housing which supports plural first connection terminals in its inside;

a second connector having a second connector housing which supports plural second connection terminals connected to the plural first connection terminals in its inside; and a magnetic member disposed in at least one of the first connector housing and second connector housing, wherein said magnetic member is disposed so as to be held between leading ends of the plural first connection terminals or between leading ends of the plural second connection terminals, and a magnetic field is generated in a direction orthogonal to a direction in which the both first and second connection terminals are inserted during a period of time from complete engagement of the first and second connectors to complete disengagement thereof, or during a period of time from complete disengagement of the first and second connectors to complete engagement thereof;

said connector further comprising an annular yoke disposed in the first connector housing or second connector housing so as to pinch leading ends of a plurality of first or second connection terminals, the yoke concentrating a magnetic field generated by the magnetic member in the first and second connection terminals in a period from complete fitting till complete separation of the first and second connectors or from complete separation till complete fitting.

2. The connector according to claim 1, wherein said magnetic member is a magnet.

3. The connector according to claim 2, wherein said magnet is a permanent magnet.

4. The connector according to claim 2, wherein said magnet is an electromagnet.

5. The connector according to claim 1, wherein said plural first and second connection terminals arranged at confronting positions across the location of the magnetic member are respectively disposed in the first and second connector housings so as to be symmetrical on both sides of the magnetic member.

6. The connector according to claim 5, wherein said magnetic member is a magnet.

7. The connector according to claim 6, wherein said magnet is a permanent magnet.

8. The connector according to claim 6, wherein said magnet is an electromagnet.

9. An electric connection structure comprising:

a first member which supports plural first connection terminals in its inside;

a second member which supports plural second connection terminals connected to the plural first connection terminals in its inside; and a magnetic member disposed in at least one of the first member and second member, wherein said magnetic member is disposed so as to be held between leading ends of the plural first connection terminals or between leading ends of the plural second connection terminals, and a magnetic field is generated in a direction orthogonal to a direction in which the both first and second connection terminals are inserted during a period of time from complete engagement of the first and second members to complete disengagement thereof, or a period of time from complete disengagement of the first and second members to complete engagement thereof;

said connector structure further comprising an annular yoke disposed in the first member or second member so as to pinch leading ends of a plurality of first or second connection terminals, the yoke concentrating a magnetic field generated by the magnetic field generated by the magnetic member in the first and second connection terminals in a period from complete fitting till complete separation of the connectors of the first and second members or from complete separation till complete fitting.

10. The electric connection structure according to claim 9, wherein said magnetic member is a magnet.

11. The electric connection structure according to claim 10, wherein said magnet is a permanent magnet.

12. The electric connection structure according to claim 10, wherein said magnet is an electromagnet.

13. The electric connection structure according to claim 9, wherein said plural first and second connection terminals arranged at confronting positions across the location of the magnetic member are respectively disposed in the first and second connector housings so as to be symmetrical on both sides of the magnetic member.

14. The electric connection structure according to claim 13, wherein said magnetic member is a magnet.

15. The electric connection structure according to claim 14, wherein said magnet is a permanent magnet.

16. The electric connection structure according to claim 14, wherein said magnet is an electromagnet.

* * * * *